US009265298B2

(12) United States Patent
Viltrakis et al.

(10) Patent No.: US 9,265,298 B2
(45) Date of Patent: Feb. 23, 2016

(54) CLAMP FIXTURE FOR EMBROIDERING A CAP

(71) Applicants: Vytenis J. Viltrakis, Fort Thomas, KY (US); Mark Mason, Fairfield, OH (US)

(72) Inventors: Vytenis J. Viltrakis, Fort Thomas, KY (US); Mark Mason, Fairfield, OH (US)

( * ) Notice: Subject to any disclaimer, the term of this patent is extended or adjusted under 35 U.S.C. 154(b) by 0 days.

(21) Appl. No.: 14/455,486

(22) Filed: Aug. 8, 2014

(65) Prior Publication Data

US 2015/0173448 A1 Jun. 25, 2015

Related U.S. Application Data

(66) Substitute for application No. 61/917,981, filed on Dec. 19, 2013.

(51) Int. Cl.

| | |
|---|---|
| ***D05B 39/00*** | (2006.01) |
| ***D05C 9/04*** | (2006.01) |
| ***A42C 1/06*** | (2006.01) |
| ***A42C 1/00*** | (2006.01) |

(52) U.S. Cl.

CPC ... *A42C 1/06* (2013.01); *A42C 1/00* (2013.01); *D05B 39/00* (2013.01); *D05C 9/04* (2013.01)

(58) Field of Classification Search

CPC ..... D05B 21/00; D05B 21/31; D05B 39/00; D05C 9/04; A42C 1/06

USPC ..... 112/103

See application file for complete search history.

(56) References Cited

U.S. PATENT DOCUMENTS

| | | | | |
|---|---|---|---|---|
| 4,665,844 | A * | 5/1987 | Shibata | 112/103 |
| 4,831,753 | A * | 5/1989 | Inteso | 38/102.3 |
| 5,887,534 | A * | 3/1999 | French et al. | 112/103 |
| 6,189,468 | B1 * | 2/2001 | French | 112/103 |
| 6,463,867 | B2 * | 10/2002 | Kato | 112/103 |
| 7,080,602 | B2 * | 7/2006 | Kawaguchi et al. | 112/103 |
| 2002/0038621 | A1 * | 4/2002 | Ozeki | 112/103 |

FOREIGN PATENT DOCUMENTS

DE 19637866 A1 * 3/1998

* cited by examiner

*Primary Examiner* — Ismael Izaguirre

(74) *Attorney, Agent, or Firm* — Porter, Wright, Morris & Arthur, LLP; James Liles

(57) ABSTRACT

A clamp fixture for supporting a baseball type cap of the type having a crown portion and a brim portion that extends outwardly from the crown on an embroidery machine includes a brim band having a curvilplanar configuration to resiliently urge the bill of a cap out of the path of a embroidery machine head, and allows embroidery on the lower portion of the crown portion, adjacent to the brim portion.

25 Claims, 6 Drawing Sheets

CLAMP FIXTURE FOR EMBROIDERING A CAP

RELATED APPLICATIONS

This application claims priority to Provisional Application No. 61/917,981 filed Dec. 19, 2013.

TECHNICAL FIELD

The present invention relates generally to fixtures for supporting articles on an embroidery machine during an embroidery process and more specifically to a clamp attachable to a cap driver of an embroidery machine for securing a cap of the type having a crown and a brim and/or bill portion as the cap is being embroidered. The invention will be disclosed in connection with a clamp fixture that secures and positions a baseball or similar type of cap during the embroidery process so the lower portion of the cap crown can be embroidered in an area adjacent to the brim or bill of the cap.

BACKGROUND OF THE INVENTION

It has become increasingly popular to place logos or other graphic or printed content on the front crown portions of caps and hats. The logos, designs or other printed content typically show affiliation with a team or organization. One type of cap for which a name, logo or other written indicia is often desired is a soft cap with a rounded crown and a stiff brim projecting in front. This will type of cap is typically referred to as a baseball cap. Members of baseball teams have long worn these types of caps as part of their team uniforms. When used as part of a uniform, it has long been common for the front crown portion of the camp to display a design, logo, word or letter that symbolizes the team.

In more recent years, this same type of cap has been increasingly worn by casual wearers who are not necessarily baseball team members, but who are merely wearing these types of hats as part of their casual attire. These types of caps also are worn causally by non-players with team logos or designs of their favorite team as an indication of their support or affection for that team. The identifying logo or design most typically is located on the front of the crown portion of a cap. Using logos or designs on baseball caps to show affiliation extends beyond baseball teams. Baseball type hats are also widely used today as instruments of commercial advertising and promotion, wherein company names or logos are on caps in a similar manner, and used to promote organizations or products.

Most commonly, display logos or designs are placed, at least, in the front, center portions of the cap crown. As the myriad of contemporary uses of baseball type caps expands, there has been increasing interest in placing larger designs, or multi-component designs or textual matter on the front crown portion of baseball caps. For this reason, there has been increasing interest in enlarging the portion of the cap's crown used for display of the logos, designs or displayable textual material.

Embroidery is most often recommended and often most preferred way of decorating crown portion of baseball type caps and applying logos designs or displayable textual material thereto. When sewing baseball and other types of caps on an embroidery machine, it is common to secure and control the position of a cap during the embroidery process with a specially designed fixture, such as that shown in U.S. Pat. No. 5,819,675, assigned to the assignee of the present invention. While the fixture shown and described in this patent has been very successful, it is not without its disadvantages when attempting to sew about the lower portion of the crown portion of a baseball type cap, adjacent the brim. Due to the size and thickness of sewing heads on many embroidery machines, it becomes problematic with these types of fixtures to position a cap so the head of an embroidery machine can be put into an optimal position to sew the lower portion of the cap crown, particularly in the area adjacent to the cap's interface with the brim or bill of the cap. There therefore is a need in the prior art for gaining access to the lower portion of a cap crown with an embroidery machine.

BRIEF SUMMARY

One example of the invention is an embroidery machine clamp fixture for supporting a cap of the type having a crown portion and a brim or portion that extends outwardly from the crown portion. The clamp fixture includes a cap saddle frame that extends from a first end portion to a second end portion along a curved path. First and second clamping posts are supported by the cap saddle frame at spaced positions along the cap saddle frame's curved path. The first and second clamping posts extend outwardly from a first side of the cap saddle frame in generally parallel spaced relationship to each other. A clamping member with a first end portion and a second end portion has its first end portion hingedly interconnected to the cap saddle frame. The second end portion is releasably securable to the cap frame saddle's second end portion. The clamping member has a pair of clamping surfaces that are spaced in correspondency to the first and second clamping posts on the cap saddle frame. These clamping posts are adapted to cooperatively interact with the clamping posts on the cap saddle frame to compressing engage a fabric therebetween whenever the second end portion of the clamping frame member is secured to the cap frame saddle. A brim band extends from one portion of the clamping frame to the another portion and is externally disposed to and spaced from the cap saddle frame when the clamping frame member is securably connected to the cap saddle frame. The brim band has a contact surface proximal to the cap saddle frame and is obliquely oriented with respect thereto. The brim band is operative to control the position of a brim portion of a cap when a brim portion of a cap with a brim is interposed between the cap saddle frame and the clamping member. More specifically, the brim band is operative to increase the angle between the crown and bill portions of the cap and to hold the brim portion of the cap at an obtuse angle (between 90° and 180°) with respect to the cap crown. This allows the sewing head on an embroidery machine to access the lower portion of the crown of a cap adjacent to the cap brim for a cap secured by the clamp fixture.

In one specific form of the invention, the cap saddle frame extends from the first end portion to the second end portion along a curved path that has a generally constant radius, and the curved path is sized and configured to fit within the interior of a crown portion of a cap.

In another specific form of the invention, the clamping frame member is hingedly interconnected to the cap saddle frame at a location proximal to one of the cap saddle frame's end portions.

In another specific form of the invention, the clamping frame member is releasably secured to the cap saddle frame at a location proximal to the cap saddle frame's second end portion of the cap saddle frame opposite the hinge.

In another specific form of the invention, the contact surface of the brim band has a generally frusto-conical configuration.

In another specific form of the invention, the contact surface of the brim band has a curviplanar configuration that is smooth and continuous, without abrupt surface changes to a portion of which is curved.

In another specific form of the invention, the clamping posts on the cap saddle frame each include a plurality of projections, and the clamping surfaces on the clamping member include recesses that are sized and configured to receive the projections and capture an interposed fabric and backing material when the second end of the clamping frame member is securably attached to the cap frame saddle.

In another specific form of the invention, the brim band includes at least one alignment confirmation opening for visually confirming that a cap interposed between the brim band and the cap saddle frame is properly positioned with respect to the clamp fixture.

In another specific form of the invention, the brim band includes a plurality of alignment confirmation openings for visually confirming proper positioning of a cap interposed between the brim band and the cap saddle frame.

In another specific form of the invention, the alignment confirmation openings are positions to provide visual access to a seam connecting the brim of a cap to a cap crown when a cap is interposed between the clamping frame member and the cap saddle frame.

In another specific form of the invention, the portion of the cap saddle frame extending along the curved path is shaped and configured to support an internal sweat band of a cap when a cap is interposed between the clamping frame member and the cap saddle frame.

In another specific form of the invention, the plurality of projections on the clamping posts of the cap saddle frame include tapered end portions that converge to a point.

In another specific form of the invention, the cap saddle frame includes spring clips for retaining a backing member for an inner portion of a crown portion to a cap saddle frame when a cap is interposed between the cap frame member and the clamping member.

In another specific form of the invention, the curved path along which the cap saddle frame extends has a radius of between 2.5 and 3.5 inches.

In another specific form of the invention, the brim band is made from T-301 full hard spring temper stainless steel.

In another specific form of the invention, the curved path along which the cap saddle frame extends has a diameter of approximately 3.5 inches.

In another specific form of the invention, a curved extension of the cap saddle frame includes a reinforcing rib extending from one portion of the curved extension to another intermediate the first and second sides of the cap saddle frame, and the reinforcing rib forms a planar positioning surface for a brim of a cap.

In another specific form of the invention, at least one retaining bill locating retaining tab is included on the clamping posts to hook to and engage the underside of a bill of a cap to keep the bill from moving relative to the cap saddle frame.

BRIEF DESCRIPTION OF THE DRAWINGS

While the specification concludes with claims which particularly point out and distinctly claim the invention, it is believed the present invention will be better understood from the following description taken in conjunction with the accompanying drawings, in which like reference numbers identify the same elements in which:

Reference will be made to certain exemplary embodiments of the invention, examples of which are illustrated in the accompanying drawings.

DETAILED DESCRIPTION OF THE EXEMPLARY EMBODIMENTS

Figure 1:
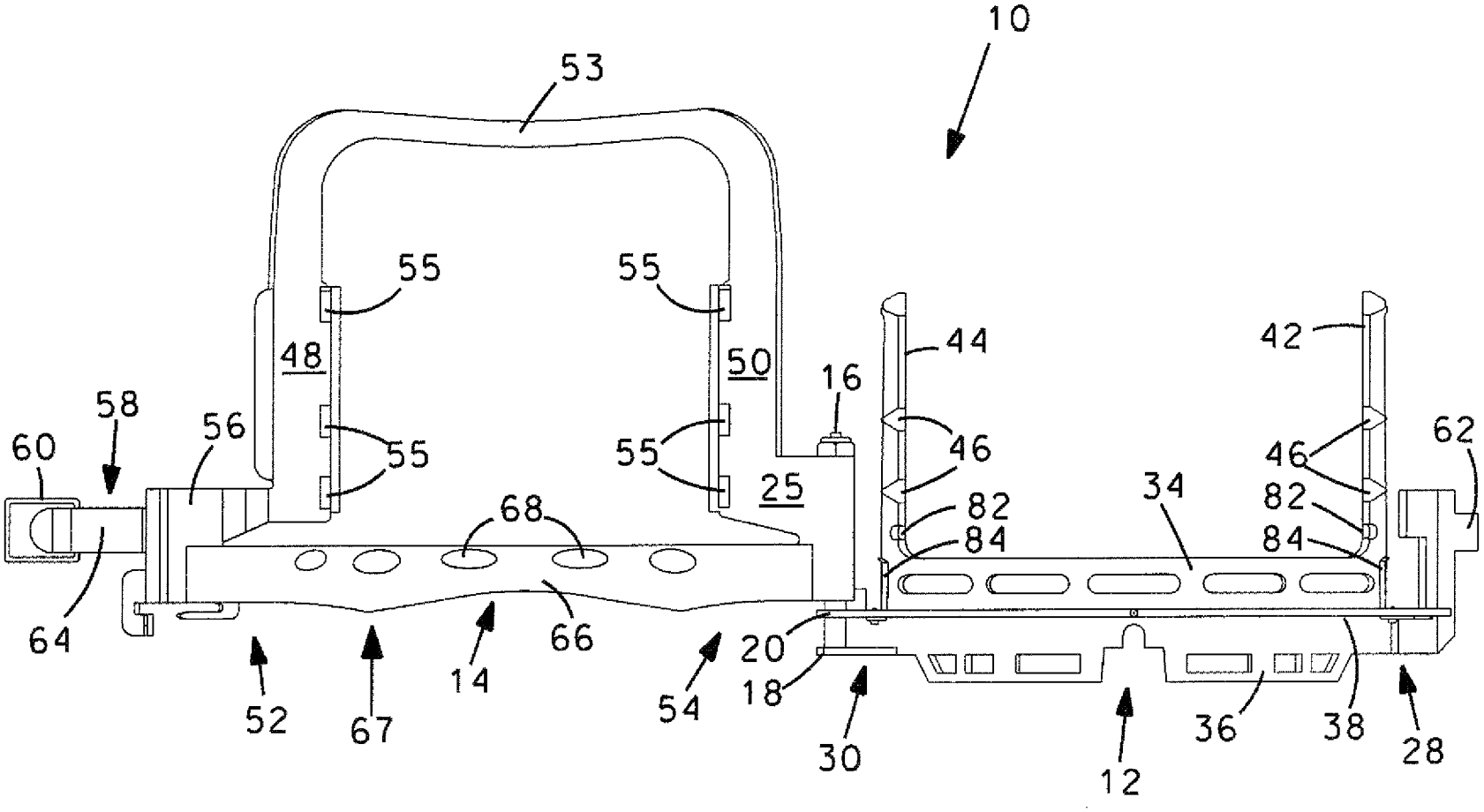
FIG. 1 is an elevational view of a clamp fixture constructed in accordance with the principles of the invention the clamp showing a cap saddle frame with its associated clamping member in a fully open position with the cap saddle frame and clamping member in side-by-side relationship.

Referring now to the drawings, FIG. 1 shows one form of an clamp fixture 10 constructed under the principles of the present invention. The clamp fixture 10 includes two principal components, a cap saddle frame 12, shown on the right hand side of FIG. 1, and a clamping member 14 on the left hand side of that same drawing figure. The clamping member 14 is hingedly connected to the cap saddle frame 12 by a pin 16 fixedly secured to a pair of flanges 18 and 20 that extend outwardly from the cap saddle frame 12 proximal to a first end portion of the cap saddle frame. The pin 16 extends upwardly (as shown in FIG. 1) from the flanges 18 and 20, and interfaces with a pair of flanges 22 and 24 (see FIGS. 3 and 4) that extend outwardly from the clamping member 14. Flanges 22 and 24 have axially aligned apertures (not shown) through which the pin 16 extends. A nut 26 prevents upward (in the orientation depicted in FIG. 1) movement of the flanges 22 and 24 off the pin 16 once the pin 16 is extended through the aligned apertures (not shown) in flanges 22 and 24. The flanges 22 and 24 extend from a flange extension 25 (FIG. 1) to which remainder of the clamping member 14 is attached.

Figure 2:
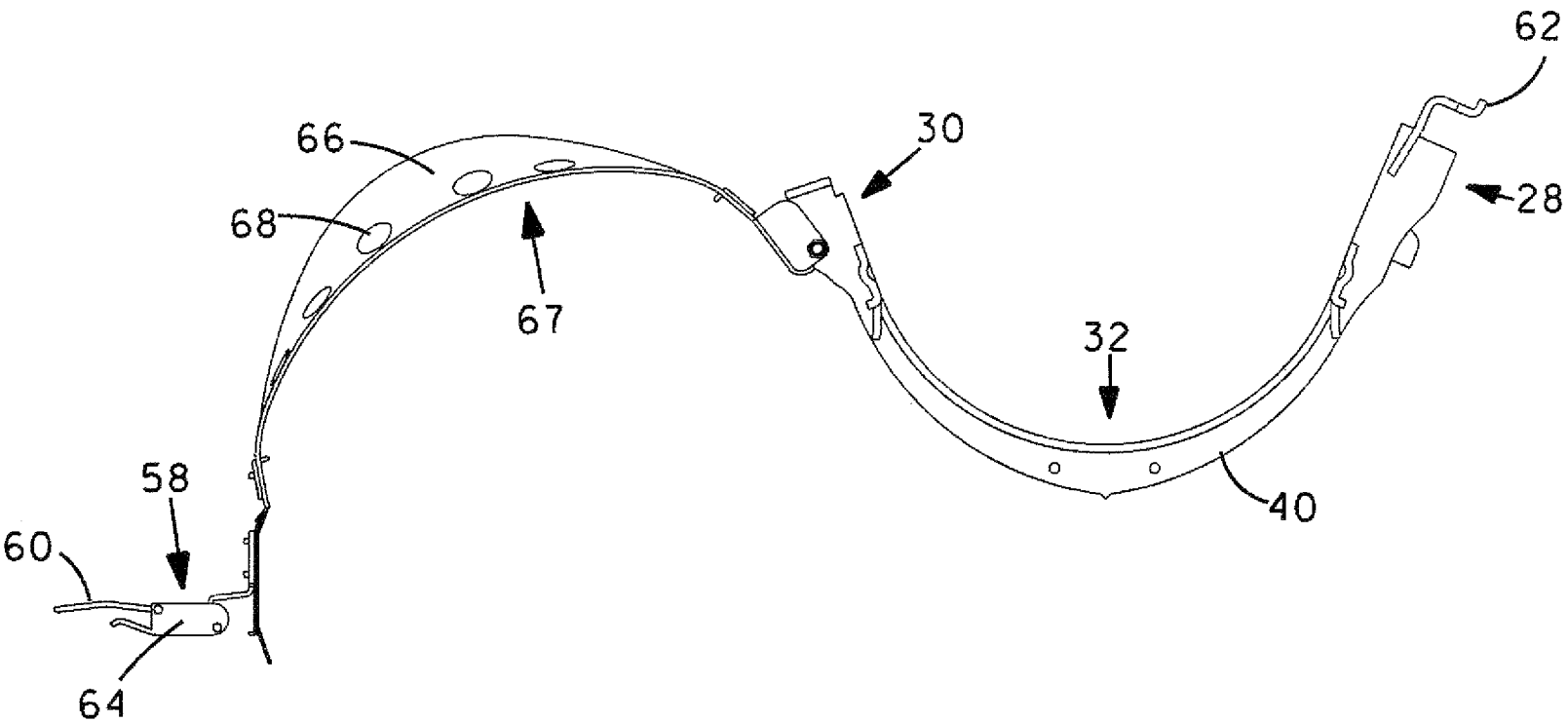
FIG. 2 is a plan view of the clamp fixture in FIG. 1.

The cap saddle frame 12 extends along a curve path 32, best shown in FIG. 2, between the first end portion, indicated by the numeral 28 and a second end portion, indicated by the numeral 30. In one preferred embodiment, the curved path has a generally constant radius sized and configured to interface with the interior of a crown portion of a baseball type cap. In one preferred embodiment, the radius is between 2.5 and 3.5 inches, preferably approximately 3 inches. As best shown in FIG. 1, the portion of the cap saddle frame along the curved path 32 includes three principle components, an internal sweatband support 34, an embroidery machine interface 36 and a reinforcing rib 38. The internal sweatband support 34 and machine interface 36 extend respectfully upwardly and downwardly as seen in the orientation depicted in FIG. 1, in a direction generally perpendicular to curved path 32. The machine interface 36 is adapted to engage a cap driver of an embroidery machine.

Figure 4:
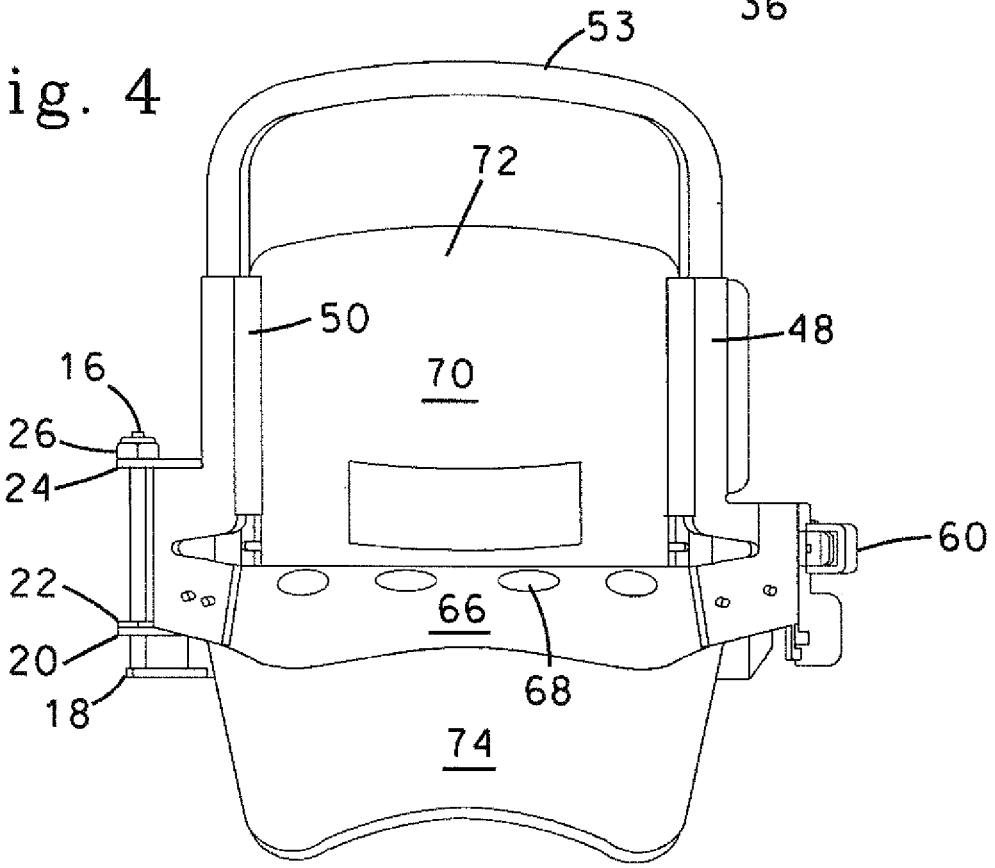
FIG. 4 is a front elevational view similar to FIG. 3, but showing a cap disposed between the cap saddle frame and the clamping member.
Figure 5:
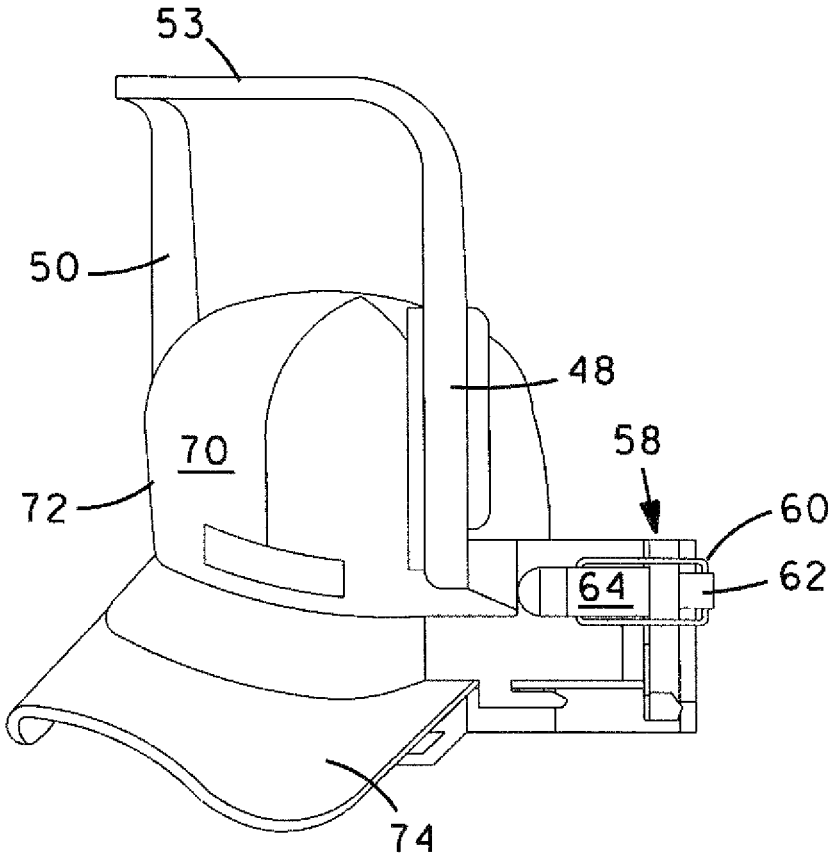
FIG. 5 is a perspective view of the clamp fixture and cap in FIG. 4.

From jointly viewing FIGS. 1 and 2, it can be seen that the reinforcing rib 38 extends outwardly from and in a direction generally perpendicular to the internal sweatband support 34 and machine interface 36, and provides a generally planar surface 40. As will be further explained below, this surface 40 forms a planar positioning surface for supporting the brim or bill of a cap when a cap having a brim is interposed between the cap saddle frame 12 and clamping member 14 as shown in FIGS. 4 and 5. For purposes of the present specification and claims, the terms "brim" and "bill" are used interchangeably, and will refer to a structure projecting outwardly from the bottom of a cap crown.

The cap saddle frame 12 further includes a pair clamping posts 42 and 44 which extend upwardly from opposite ends of the internal sweat band support 34 in generally perpendicular relationship to the planar positioning surface 40. In the depicted embodiment, the clamping post will 42, 44 are angularly displaced from each other by approximately 145° about the curved path 32. Each of the clamping post 42 and 44 include a plurality of projections 46. Each of the illustrated projections 46 include tapered end portions that converge to a point.

Figure 3:
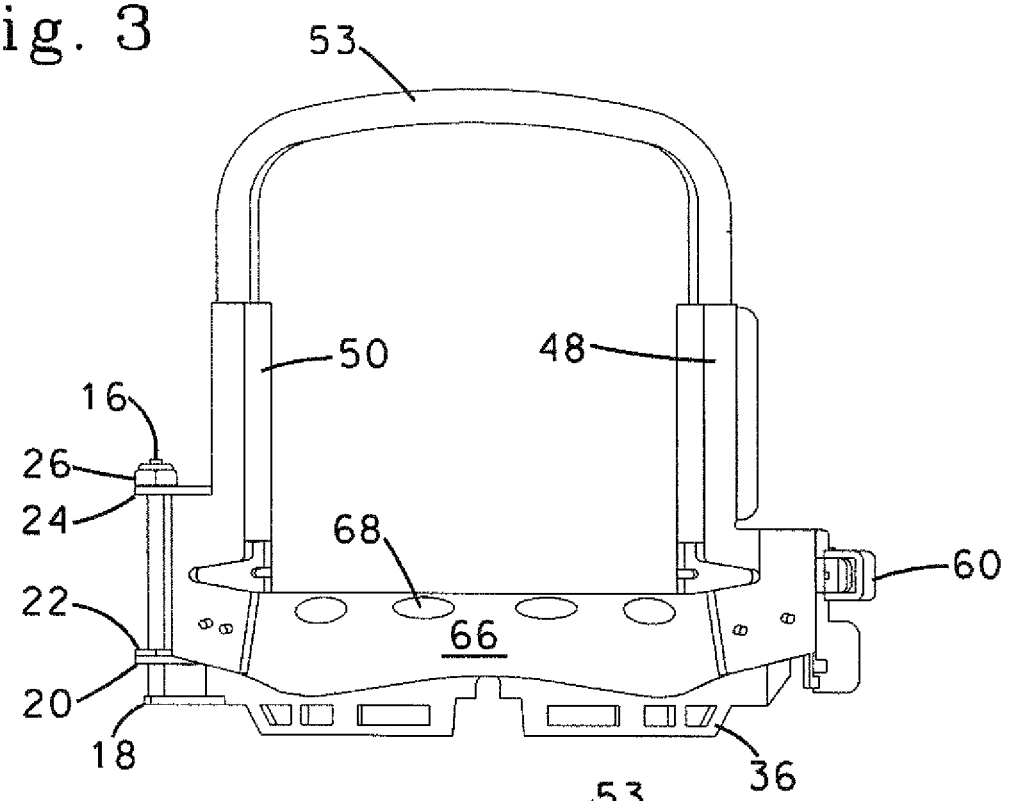
FIG. 3 is a front elevational view of the clamp fixture of FIGS. 1 and 2 with the clamping member in a closed position.

The clamping member 14 includes a pair of clamping surfaces 48 and 50 which extend respectively from first and second end portions 52 and 54 of the clamping member 14. The clamping surfaces 48 and 50 are spaced in correspondency to the spacing of the clamping posts 42 and 44, and are angularly displaced from each other by about 145°. Clamping surface 50 is connected to the flange extension 25 to allow the clamping member 14 to pivot about the axis of pin 16 and to hingedly connect clamping member 14 to the cap saddle frame 12. The clamping surfaces 48 and 50 are angularly aligned to mate with the first and second clamping posts 42 and 44 of the cap saddle frame 12 when the clamping member 14 is moved to the closed position depicted in FIGS. 3-5. In the specific embodiment illustrated, each of the clamping surfaces 48 and 50 has three recesses 55 configured and vertically spaced on the clamping surfaces 48,50 to align with the projections 46 on the clamping posts 42,44 when the clamp fixture 10 is in the closed position (FIGS. 3-5). The first and second clamping posts 42 and 44 are joined by a bridge 53 which extends upwardly from the clamping surfaces 48 and 50 and traverses the distance therebetween along a path having the same curvature as the cap saddle frame 12. The clamping surface 48 is attached to a latch extension 56, which latch extension 56 supports a fastener for releaseably connecting the first end portion 52 of the clamping member 14 the first end portion 28 of the cap saddle frame 12.

The illustrated fastener is a straight loop latch assembly 58 having a fastening loop 60. As perhaps best illustrated in FIG. 5, the fastening loop 60 is placed over a loop catch 62 projecting outwardly from the first end portion of the cap saddle frame 12. As those skilled in the art will readily appreciate, once the fastening loop 60 is placed over the loop catch 62, the fastening loop is rotatably retracted by movement of a lever 64 that forms port of the latch assembly 58.

Figure 6:
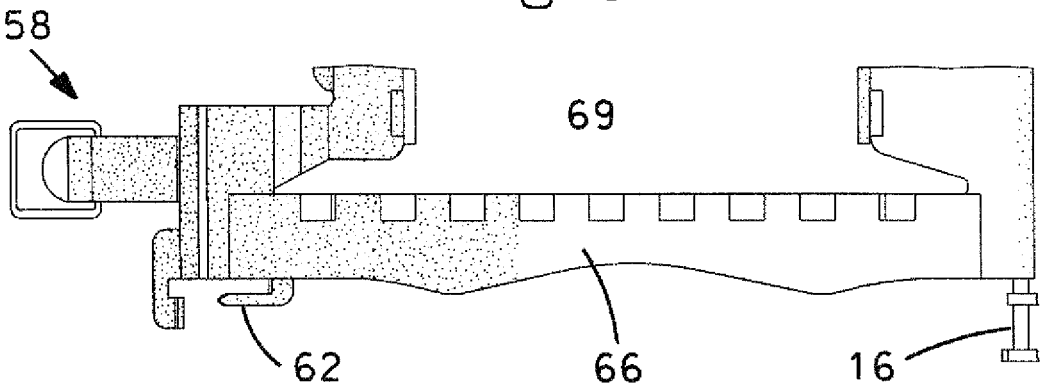
FIG. 6 is a fragmentary front elevational view of an alternative form of brim band.
Figure 7:
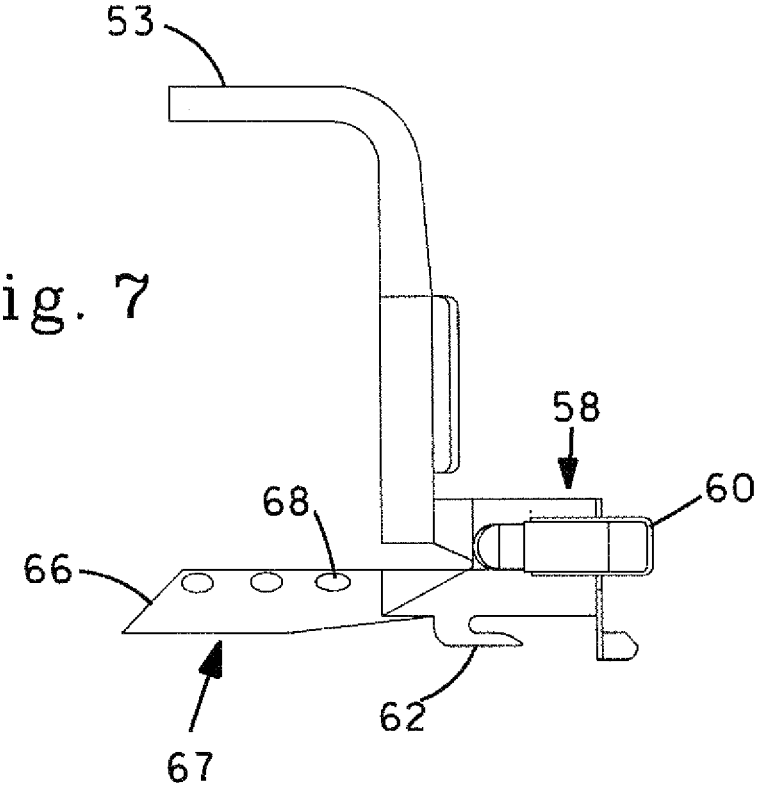
FIG. 7 is a side elevational view of a cap saddle frame showing the oblique orientation of the brim band relative to the cap saddle frame.

Significantly, the clamp fixture 10 includes a brim band 66 that extends from the first portion 52 of the clamping frame 12 to the second portion 54. The brim band 66 has a generally frusto-conical configuration with a generally smooth curviplanar contact surface 67 (on the underside of the brim band 66 as shown in FIG. 1) obliquely oriented with respect to the cap saddle frame. As used in the present specification and claims, the term "curviplanar" is used to denote a surface that is smooth and continuous, without abrupt changes in at least the portion of the surface which is curved. As further explained below, the brim band 66 is intended to contact a brim or bill of a cap when the clamping member 14 is in its closed position, as shown in FIGS. 3-5. The brim band 66 is connected at its opposite ends to latch extension 56 and hinge extension 25 respectively. It extends between the first and second end portions 52 and 54 along a curved path that approximates that of the cap saddle frame. In one preferred form, the brim band 66 includes a plurality of alignment confirmation openings 68 that allow visual access to an interposed cap, particularly to the interface of the cap at the crown and bill portions. This visual access allows confirmation that a cap interposed between the brim band 66 and cap saddle frame is properly positioned within the clamp fixture 10. In one of the preferred embodiments, shown in FIG. 1, the openings 68 are formed as aperatures in the brim band 66. Alternatively, as shown in FIG. 6, alignment confirmation openings can be formed by configuring the brim band 66 with a series of rectangular-shaped open-ended openings 69 that extend from the edge of the brim band 66, giving the brim band 66 a tooth-like appearance. The visual access openings 69 in FIG. 6, like the visual access openings 68 in FIG. 1, are located along the curved path of the brim band 66 that extends between the brim band's opposite ends, which opposite ends are correspond to portions 52 and 54 in the depiction of FIG. 1.

FIGS. 4-5 depict the clamp fixture 10 depicted in FIGS. 1-3 with a cap 70 disposed between the clamping member 14 and cap saddle frame 12. The cap 70 illustrated includes a crown portion 72 with a bill portion 74 projecting from the lower front portion of the crown 72. The cap saddle frame 12 of the illustrated fixture embodiment is designed to receive a baseball or similar type of cap having an internal sweat band that extends around the lower internal peripheral edge of the crown portion 72. The internal sweat band support 34 is configured to engage the front portion of the cap's sweatband (not shown in the drawings, but located about the peripheral base of the crown portion, adjacent to the cap brim. The radius of the front sweat band support 34 of one exemplary embodiment is between approximately 2.5 inches and 3.5 inches, preferably approximately 3 inches, a radius that conforms to the radius of a large majority of baseball or similar caps.

The first and second clamping posts 42,44 are positioned to fit within the interior of the crown portion 72 of the cap 70, and to cooperatively interact with the clamping surfaces 48, 50 and compressingly engage a cap fabric (usually a paper backing material 76—see FIG. 8) interposed between the clamping posts and the clamping surfaces 48, 50 of the clamping member 14 when the clamping member 14 is in the closed position shown if FIGS. 3-5. The cap crown portions 72 of baseball type caps often are relatively flexible and lack the rigidity required for embroidering. It is common to back up the areas of the cap crown to be embroidered with backing material during the actual embroidery process, and to remove the backing material once the embroidery process is completed.

Figure 8:
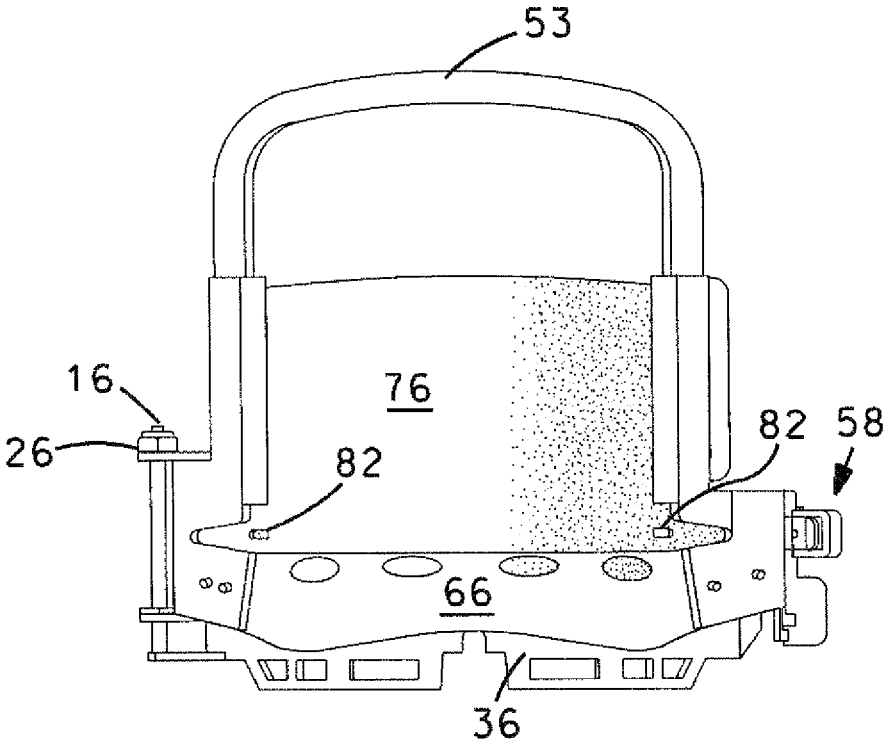
FIG. 8 is a front elevational view similar to FIG. 3, but showing a backing member secured to the saddle frame.

The backing material 76, shown in FIG. 8, typically is formed from a semi-rigid paper stock which provides the rigidity the crown portion of a baseball type cap lacks. For a cap 70 such as shown in the illustrated embodiments, the illustrated paper backing material 76 is a rectangular piece of paper of approximately 11 inches by 4 inches that is used behind the portion of the cap being embroidered, i.e., the front center section of the crown portion 72, as is typical in embroidery operations. When used in connection with the illustrated clamp fixture shown in the drawings, this rectangular-shaped backing material is pre-fitted on the clamp fixture prior to placing a cap 70 between the cap saddle frame 12 and the clamping member 14. With the clamping member 14 in an open position (as shown in FIG. 1), a lower elongated edge of the backing sheet 76 is curved around the internal sweatband support 34 with its lateral edge against the surface 40 and its internal surface in contacting relationship with the reinforcing rib 38. The opposite longitudinal ends of the backing sheet 76 are respectively wrapped around clamping posts 42 and 44. Clips 84 (see FIG. 1) are disposed respectively at lower sections of clamping posts 42 and 44 and extending upwardly (in the orientation depicted in FIG. 1) from the planar surface 40 compressingly engage the outer surface of the backing material sheet 76 against the internal sweatband support 34 and secure the backing material sheet 76 in the above-described position on the cap saddle frame 12. As the backside of the backing sheet 76 is urged against internal sweatband support 34, bill locating/retaining tabs 82 (see FIGS. 1 and 8), which locating/retaining tabs extend outwardly beyond the sweatband support 34, protrude through the backing material sheet 76, as depicted by the protruding tabs 82 in FIG. 8.

When a cap is interposed between the cap saddle frame 12 and clamping member 14 as shown in FIGS. 4 and 5, locking the clamping member 14 to the cap saddle frame 12 further positions the interior contact surface 67 of the brim band 66 against the brim or cap bill 74, and urges the cap bill 74 against the planar positioning surface 40. Pushing the cap brim band 66 against the brim or cap bill 74, however, also urges the cap crown 72 and (if the cap bill 74 is other than planar) the peripheral portions of the cap bill 74 in the opposite direction, away from the planar surface 40. In one preferred form of the invention, this unwanted movement of the cap crown 72 and peripheral edges of the brim or cap bill 74 is prevented by the bill locating/retaining tabs 82. These bill locating/retaining tabs 82 engage and retain the portion of the cap bill 74 adjacent to the cap crown 72. As the brim band 66 applies pressure to the cap bill 74, it angularly separates the bill and crown portions 74,72 of the cap 70 and positions the cap bill 74 at an obtuse angle (i.e., between 90° and 180°) with respect to the cap crown 72. The bill locating/retaining tabs 82 and 84 then engage the interior edge of the bill portion and prevent unwanted movement and misalignment of the crown portion 72. As a consequence, the edge of the cap crown 72 adjacent to the cap bill 74 is aligned with the planar surface 40, and the cap bill is angularly displaced with respect to the cap crown 72, allowing access to the lower portion of the cap crown with the head of an embroidery machine. This allows the lower front portion of the crown portion 72 to be embroidered close to the interface between the crown portion 72 and the bill 74 of the cap 70, and allows virtually the entire front portion of the cap crown 72 to be embroidered. The embroidering of larger designs or multi-component designs or textual matter that could not heretofore be embroidered on the front crown portion of a cap is permitted.

The brim band 66 preferably is made from a spring steel alloy, preferably a stainless steel. In one preferred embodiment, the brim band is made from T-301 full hard spring temper stainless steel, has a tensile strength of 185,000 PSI minimum, and a minimum yield strength of 140,000 PSI. The combination of hardness and toughness which gives the brim band 66 resilient spring properties. Due to these spring properties, the brim band 66 urges the bill 74 of a cap downwardly, increasing the angle between the crown and bill portions 72 and 74.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such embodiments and variations are within the scope of the invention as determined by the appended claims when interpreted in accordance with the breadth to which they are fairly, legally, and equitably entitled. The drawings and preferred embodiments do not and are not intended to limited the ordinary meaning of the claims in their fair and broad interpretation in any way.

What is claimed is:

1. A clamp fixture for supporting a cap of the type having a crown portion and a brim portion that extends outwardly from the crown portion in an embroidery machine, the clamp fixture comprising:

(a) a cap saddle frame, the cap saddle frame extending along a curved path;

(b) first and second clamping posts supported by the cap saddle frame at spaced positions along the cap saddle frame's curved path, the first and second clamping posts extending outwardly from a first side of the cap saddle frame in generally parallel relationship to each other;

(c) a clamping member, the clamping member being movably connected to the cap saddle frame about a first end portion of the clamping member that is hingedly interconnected to the cap saddle frame so as to facilitate movement of the clamping member between open and closed positions relative to the cap saddle frame, the clamping member having a second end portion that is releasably securable to the cap frame saddle's second end portion when the clamping member is in the closed position, the clamping member including (i) a brim band extending between the first and second end portions of the clamping member, and (ii) a pair of clamping surfaces that are spaced in correspondency to the first and second clamping posts on the cap saddle frame, the pair of clamping surfaces being adapted to cooperatively interact with the clamping posts on the cap saddle frame to compressingly engage a fabric therebetween whenever the second end portion of the clamping frame member is secured to the cap frame saddle;

(d) the brim band extending from one portion of the clamping member to another portion, the brim band being movable with the clamping member as the clamping member is moved between open and closed positions, the brim band being externally disposed to the cap saddle frame when the clamping frame member is securably connected to the cap saddle frame's second end portion, the brim band having a contact surface proximal to the cap saddle frame that is obliquely oriented with respect to the cap saddle frame, the contact surface being positioned relative to the cap saddle frame so as to be operative to apply pressure against a brim portion of a hat having a brim portion when a cap having a crown portion and a brim portion is interposed between the cap saddle frame and the brim band, and the clamping member is in a closed position with the second end of the clamping frame secured to the cap saddle frame.

2. A clamp fixture as recited in claim 1 wherein the cap saddle frame extends from the first end portion to the second end portion along a curved path that has a generally constant radius, and the curved path is sized and configured to fit within the interior of a crown portion of a cap.

3. A clamp fixture as recited in claim 1 wherein the contact surface of the brim band has a generally frusto-conical configuration.

4. A clamp fixture as recited in claim 3 wherein the contact surface of the brim band has a generally smooth curviplanar configuration.

5. A clamp fixture as recited in claim 1 wherein the clamping posts on the cap saddle frame each include a plurality of projections, and the clamping surfaces on the clamping member includes recesses sized and configured to receive the projections when the second end of the clamping frame member is securably attached to the cap frame saddle.

6. A clamp fixture as recited in claim 1 wherein the brim band includes at least one alignment confirmation opening for visually confirming a cap interposed between the brim band and the cap saddle frame has a predetermined position on the clamp fixture.

7. A clamp fixture as recited in claim 6 wherein the brim band includes a plurality of alignment confirmation openings for visually confirming a cap interposed between the brim band and the cap saddle frame has a predetermined position on the clamp fixture, the alignment confirmation openings being located at spaced locations along the curve path of the brim band between the opposite ends of the brim band.

8. A clamp fixture as recited in claim 7 wherein the plurality of alignment confirmation openings includes at least one aperture extending through the brim band.

9. A clamp fixture as recited in claim 7 wherein the plurality of alignment openings includes at least one open-ended opening extending inwardly from the edge of the brim band.

10. A clamp fixture as recited in claim 9 wherein the plurality of alignment openings includes a plurality of open-ended openings extending inwardly from the edge of the brim band, the plurality of open-ended openings being located at spaced locations alone the curve path of the brim band between the opposite ends of the brim band.

11. A clamp fixture as recited in claim 7 wherein the plurality of alignment confirmation openings are positioned in to provide visual access to a seam connecting the brim of a cap to a cap crown when a cap is interposed between the clamping frame member and the cap saddle frame.

12. A clamp fixture as recited in claim 1 wherein the portion of the cap saddle frame extending along the curved path is shaped and configured to support an internal sweat band of a cap when a cap is interposed between the clamping frame member and the cap saddle frame.

13. A clamp fixture as recited in claim 5 wherein the plurality of projections on the clamping posts of the cap saddle frame includes tapered end portions that converge to a point.

14. A clamp fixture as recited in claim 1 wherein the cap saddle frame includes spring clips for retaining the position of a backing material when a cap is interposed between the cap saddle frame member and the clamping member.

15. A clamp fixture as recited in claim 2 wherein the curved path along which the cap saddle frame extends has a radius of between 2.5 and 3.5 inches.

16. A clamp fixture as recited in claim 1 where the brim band is made from steel alloy.

17. A clamp fixture as recited in claim 16 wherein the steel alloy is 301 full hard spring temper stainless steel.

18. A clamp fixture as recited in claim 2 wherein the first and second clamping posts are separated from each other by approximately 145° along the curved of the cap saddle frame.

19. A clamp fixture as recited in claim 1 wherein the curved path along which the cap saddle frame extends includes a reinforcing rib extending from one portion of the curved path to another, the rib forming a planar positioning surface for the brim of a cap.

20. A clamp fixture as recited in claim 1 further including at least one bill locating/retaining tab extending outwardly from each of the first and second clamping post, the bill locating/retaining tabs being spaced from the cap saddle frame and extending outwardly with respect to the curved path defined by the saddle frame to engage the interior of a crown of a cap when a cap is retained between the cap saddle frame and clamping member to prevent unwanted cap movement when the clamping member is engaged and a cap is secured between the cap saddle frame and clamping member.

21. A clamp fixture as recited in claim 1 wherein the brim band includes a series of open-ended openings on an edge of the brim band.

22. A clamp fixture as recited in claim 1 wherein the brim band is positioned relative to the cap saddle frame so as to be operative to increase the included angle between a brim portion and a crown portion of a cap to position and orient and secure a brim portion at an obtuse angle with respect to cap portion when a brim portion of a cap having crown and brim portions is interposed between the cap saddle frame and the brim band, and the clamping member is in the closed position.

23. A clamp fixture as recited in claim 1 further including at least one retaining bill locating tab adapted to engage the underside of a bill of a cap to keep the bill portion from moving relative to the cap saddle frame.

24. A clamp fixture as recited in claim 1 wherein the curved path of the cap saddle frame has a generally constant radius, and the brim band extends from one portion of the clamping member to another portion along a curved path that approximates the curved path of cap saddle frame.

25. A clamp fixture for supporting a cap of the type having a crown portion and a brim portion that extends outwardly from the crown portion in an embroidery machine, the clamp fixture comprising:

(a) a cap saddle frame extending along a curved path;

(b) first and second clamping posts supported by the cap saddle frame at spaced positions along the cap saddle frame's curved path, the first and second clamping posts extending outwardly from a first side of the cap saddle frame in generally parallel relationship to each other;

(c) a clamping member, the clamping member having a first end portion and a second end portion, the first end portion of the clamping member being hingedly interconnected to the cap saddle frame with the second end portion being releasably securable to the cap frame saddle's second end portion, the clamping member including a pair of clamping surfaces that are spaced in correspondency to the first and second clamping posts on the cap saddle frame and adapted to cooperatively interact with the clamping posts on the cap saddle frame to compressing engage a fabric therebetween whenever the second end portion of the clamping frame member is secured to the cap frame saddle;

(d) a brim band extending from one portion of the clamping member to the another portion along a curved path that approximates the curve of the cap saddle frame, the brim band being externally disposed to the cap saddle frame when the clamping frame member is securably connected to the cap saddle frame's second end portion, the brim band having a contact surface proximal to the cap saddle band that has a frusto-conical configuration and is obliquely oriented with respect to the cap saddle frame, the brim band being adapted, if a brim portion of a cap having a crown portion and a brim portion is interposed between the brim band and the cap saddle band, to engage the interposed brim portion and angularly separate the bill and crown portions of a cap, positioning the brim portion at an obtuse angle with respect to a crown portion of the cap.

* * * * *